US005779920A

United States Patent [19]

Chadha et al.

[11] Patent Number: 5,779,920

[45] Date of Patent: Jul. 14, 1998

[54] LUMINESCENT SCREEN WITH MASK LAYER

[75] Inventors: Surjit S. Chadha, Meridian; Dean A. Wilkinson, Boise, both of Id.

[73] Assignee: Micron Technology, Inc., Boise, Id.

[21] Appl. No.: 747,216

[22] Filed: Nov. 12, 1996

[51] Int. Cl.[6] ..... B44C 1/22

[52] U.S. Cl. ..... 216/12; 216/24; 216/25; 313/402; 313/409; 313/415

[58] Field of Search ..... 216/12, 24, 25; 313/402, 409, 415

[56] References Cited

U.S. PATENT DOCUMENTS

| | | | |
|---|---|---|---|
| 3,665,241 | 5/1972 | Spindt et al. | 313/351 |
| 3,755,704 | 8/1973 | Spindt et al. | 313/309 |
| 3,812,559 | 5/1974 | Spindt et al. | 29/25.18 |
| 5,210,472 | 5/1993 | Casper et al. | 315/349 |
| 5,372,973 | 12/1994 | Doan et al. | 437/228 |
| 5,578,225 | 11/1996 | Chien | 216/24 |
| 5,705,079 | 1/1998 | Elledge | 216/24 |

OTHER PUBLICATIONS

T. Sugiura, "Dyeing Color–Filters For Liquid Crystal Display", Conference Record of the 1991 International Display Research Conference, Oct. 15–17, 1991, (San Diego, CA), *IEEE*, pp. 81–84 (1991).

*Primary Examiner*—Mark Chapman

*Attorney, Agent, or Firm*—Mueting, Raasch & Gebhardt, P.A.

[57] ABSTRACT

The present invention provides luminescent screens with a mask layer, methods of manufacturing the screens, and display devices incorporating the screens. The mask layer is attached to a matrix defining the pixels in the screen and preferably includes voids formed therethrough corresponding to each pixel. The voids in the mask layer preferably have a size generally corresponding to that of the pixels near the phosphor material and narrow in the direction of the electron source.

24 Claims, 4 Drawing Sheets

LUMINESCENT SCREEN WITH MASK LAYER

FIELD OF THE INVENTION

The present invention relates to the field of luminescent display devices. More particularly, the present invention relates to luminescent screens with a mask layer, methods of manufacturing the screens, and display devices incorporating the screens.

BACKGROUND OF THE INVENTION

Luminescent display devices such as a cathode ray tube (CRT) display and field emission display (FED) rely on luminescent screens having pixels formed of distinct areas of phosphor materials that are excited by electrons directed at the material. The phosphor material emits light as it releases a portion of the energy provided by the electrons. That light is then transmitted to a viewer through a glass or other transparent material. The phosphor materials are typically inorganic or organic luminescent materials that may include "activator" atoms to modify the emitted radiation, such that the emission is in the visible region, as well as modify the emission intensity and the persistence of the image.

The electrons needed to provide the desired energy to produce a viewable display image on the screen are provided by an electron gun in a CRT display. In an FED, the electrons are provided by a plurality of cold cathode emission tips or arrays. Field emission cathode structures and methods of manufacturing them are described in, for example, U.S. Pat. Nos. 3,665,241; 3,755,704; and 3,812,559 to Spindt et al.; as well as in U.S. Pat. No. 5,372,973 to Doan et al. In either type of display, the luminescent material is typically organized in an array of pixels over the surface of the display. To enhance the sharpness of the images produced by such luminescent screens, it is preferred that the pixels are preferably small and closely-spaced.

One problem caused by the close spacing is that electrons aimed at one pixel may, for a number of reasons, be misdirected and strike an adjacent pixel, thereby exciting the wrong area of the display and reducing the color purity of the image.

Another problem with such displays is that the brightness can be reduced by light produced from the luminescent pixels being directed backwards, i.e., towards the cathode. This light may then be reflected back from the cathode onto other pixels. This also reduces the quality of the image by reducing contrast. The stray light may also cause additional problems in an FED in that the stray photons may strike light sensitive portions of the cathode, causing photo-electric stimulated emission that can further reduce the quality of the images.

Another problem associated with known displays is that as electrons strike the luminescent material in the pixels, secondary electrons are released and those secondary electrons may eventually strike luminescent material in neighboring pixels, thereby degrading the quality of the image.

As a result, a need exists for a luminescent display device with a luminescent screen that addresses the problems faced by known luminescent screens.

SUMMARY OF THE INVENTION

The present invention provides luminescent screens with a mask layer, methods of manufacturing the screens, and display devices incorporating the screens. By providing a mask layer on the screen, the excitation of pixels by misdirected electrons can be reduced and more of the light produced by the screen can be directed towards a viewer. In addition, the problems associated with photo-electric stimulated emission caused by light from the phosphor and the excitation of pixels by secondary electrons released from the phosphor material can both be reduced in screens manufactured according to the present invention.

In one aspect, the present invention comprises a luminescent screen including a generally transparent substrate having a generally transparent electrode on the substrate, the screen comprising phosphor material on the electrode, the phosphor material being located in distinct areas on the electrode, wherein the distinct areas define pixels in the screen; matrix material on the electrode, the matrix material being located between the pixels; and a mask layer having a first surface attached to the matrix material and a second surface opposite the first surface, the mask layer including voids formed through the first and second surfaces thereof, the voids generally corresponding to the pixels, wherein the area of each void is larger proximate the first surface than the area of the void proximate the second surface.

In another aspect of the present invention, a method of manufacturing a luminescent screen including a generally planar, generally transparent substrate having a generally transparent electrode is provided, the method comprising the steps of providing phosphor material on the electrode, the phosphor material being located in distinct areas on the electrode, wherein the distinct areas define pixels in the screen; providing matrix material on the electrode, the matrix material being located between the pixels; and providing a mask layer having a first surface attached to the matrix material and a second surface opposite the first surface, the mask layer including voids formed through the first and second surfaces thereof, the voids generally corresponding to the pixels, wherein the area of each void is larger proximate the first surface than the area of the void proximate the second surface.

In another aspect according to the present invention, a cathode ray tube display device is provided, the device comprising an electron gun and a luminescent screen comprising a generally transparent substrate having a generally transparent electrode on the substrate; phosphor material on the electrode, the phosphor material being located in distinct areas on the electrode, wherein the distinct areas define pixels in the screen; matrix material on the electrode, the matrix material being located between the pixels; and a mask layer having a first surface attached to the matrix material and a second surface opposite the first surface, the mask layer including voids formed through the first and second surfaces thereof, the voids generally corresponding to the pixels, wherein the area of each void is larger proximate the first surface than the area of the void proximate the second surface.

In another aspect according to the present invention, a field emission display device is provided, the device comprising a plurality of cold cathode emission structures and a luminescent screen comprising a generally transparent substrate having a generally transparent electrode on the substrate; phosphor material on the electrode, the phosphor material being located in distinct areas on the electrode, wherein the distinct areas define pixels in the screen; matrix material on the electrode, the matrix material being located between the pixels; and a mask layer having a first surface attached to the matrix material and a second surface opposite the first surface, the mask layer including voids formed through the first and second surfaces thereof, the voids generally corresponding to the pixels, wherein the area of each void is larger proximate the first surface than the area of the void proximate the second surface.

DETAILED DESCRIPTION OF THE INVENTION

The present invention provides a luminescent screen for use in any luminescent display device such as, for example, an FED panel or a CRT display. The screen includes a mask layer attached to a matrix layer defining the pixels. The mask layer assists in reducing many of the problems associated with known luminescent screens in display devices.

Figure 1:
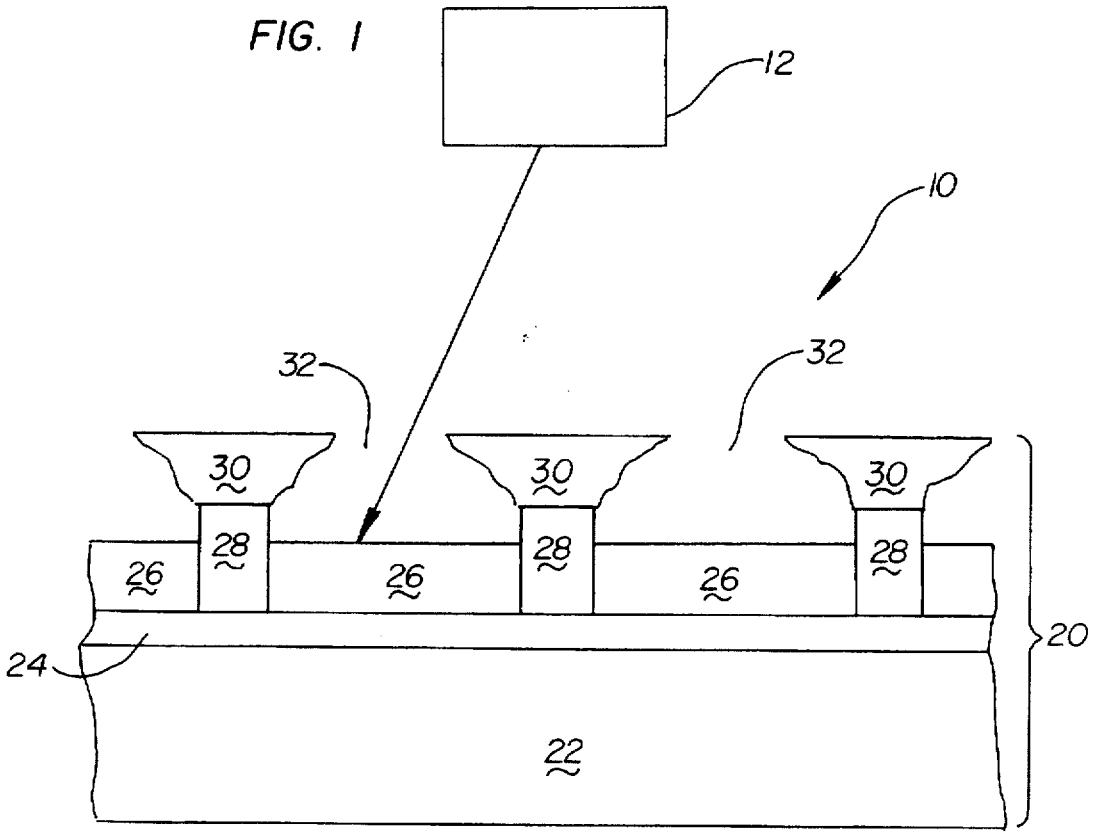
FIG. 1 is a schematic diagram of a luminescent display device including a cross-sectional diagram of a portion of the screen according to the present invention.

FIG. 1 is a schematic diagram of a luminescent display device 10 including an enlarged cross-sectional diagram of a portion of the screen 20 according to the present invention. The device 10 includes a source 12 of electrons to excite the screen 20 to produce the desired images.

The screen 20 includes a substrate 22, typically glass or another generally transparent material. The term "transparent" as used in connection with the present invention means, at a minimum, that the materials transmit visible light in sufficient amounts to allow a viewer to discern images produced by the device. It is the substrate 22 that typically is exposed to the viewer and through which the viewer is able to see the images formed by the device 10. The substrate 22 is typically generally planar, although it may have some curvature. Substrates 22 with some curvature include, for example, the screens in some CRT monitors. A more planar substrate 22 could be found in, for example, an FED panel display in a laptop computer.

On the surface of the substrate 22 that is not exposed to the viewer, a generally transparent electrode 24 is coated over substantially the entire substrate 22. The electrode 24 can be formed of any suitable material that is both generally transparent and conductive to allow for proper operation of the device. Examples of suitable materials for electrode 24 are tin oxide, indium tin oxide (commonly referred to as "ITO") or $SnO_2$. Other materials could be substituted provided they had the required electrical conductivity and were sufficiently transparent.

Distinct areas of the electrode 24 are covered by the desired phosphor material 26. Each distinct area defines a "pixel" in the display device and adjacent pixels are separated by matrix material 28, also deposited on the electrode 24. The construction of pixels on a luminescent screen 20 using phosphor material 26 and matrix material 28 is known, although one method for achieving a desired construction according to the present invention is described with reference to FIGS. 2–4 below. The areas of phosphor material 26, or pixels, can be arranged in a two-dimensional array on the electrode 24. Examples of suitable arrays include, but are not limited to: honeycomb patterns, rectilinear grid patterns, diamond patterns, etc. Alternatively, the phosphor material 26 and matrix material 28 can be provided in alternating stripes or lines, depending on the desired use for the display device 10. Furthermore, it should be noted that any array or pattern will typically be repeating, but that it need not necessarily be repeating.

The size of the distinct areas of phosphor material 26 in relationship to the width of the matrix material 28 separating those areas can vary as desired. Typically, however, the size of each distinct area of phosphor material 26 is about 30 to about 35 μm across while the width of the matrix material 28 pattern separating each distinct area is about 5 μm.

The height or thickness of the matrix material 28 on the electrode 24 is preferably about 5 to about 10 μm, more preferably about 6 to about 7 μm. The height or thickness of the phosphor material 26 is preferably about 3 to about 5 μm, more preferably about 4 μm. It is preferred that the matrix material 28 be as thick as the phosphor material 26. The ratio of the thickness of the phosphor material 26 to the thickness of the matrix material is preferably about 1:1.5 or less, more preferably about 1:1.25. The thickness of the mask 30 is preferably about 5 μm or less, more preferably about 1 to about 2.5 μm.

By providing a matrix 28 that is thicker than the phosphor material 26, additional separation can be achieved between adjacent pixels and, when combined with the mask 30, even more distinct separation can be achieved between adjacent pixels in the display.

The mask 30 includes a first surface that is attached or adhered to the exposed surfaces of the matrix material 28 as generally depicted in FIG. 1 and a second surface opposite the first surface. By attaching the mask 30 to the matrix material 28, the separation between the phosphor material 26 in adjacent pixels is enhanced. The mask 30 includes voids or openings 32 through the first and second surfaces, each of which generally correspond to the distinct areas of phosphor material 26 defining the pixels in the screen 20. Each of the voids 32 preferably varies in area (as measured when viewing the screen 20, i.e., normal to the general plane of the screen). It is preferred that the area of the voids 32 be larger in the first surface of the mask layer 30 than in the second surface of the mask layer 30. Although the voids 32 are shown in the figures as being generally the same size as the pixels in the surface of the mask 30 nearest the phosphor material 26, it should be understood that the voids 32 may be smaller or larger than the pixels in the surface of the mask 30 nearest the phosphor material 26.

Providing a mask layer 30 having such a structure addresses a number of problems associated with known luminescent screens. The mask layer 30 partially shields each pixel such that an electron directed at an adjacent pixel, but inaccurately aimed may be prevented from exciting the wrong pixel, i.e., it will be blocked from doing so by the overhanging structure of the mask layer 30. Although a similar effect could be achieved by increasing the width of the matrix material 28 separating each pixel, that would also decrease the size of each pixel, the brightness of the display, and the resolution of the images.

Another problem addressed by the mask layer 30 is that a substantial portion of the light produced by each pixel, e.g., about 50%, travels backwards, i.e., towards the electron source 12 rather than a viewer 14. The light may simply begin traveling in that direction, or it may be refracted back at the interfaces between the phosphor material 26 and electrode 24; the electrode 24 and substrate 22; or substrate 22 and air. The mask layer 30 can enhance display brightness by reflecting that misdirected light that would otherwise be "lost" for viewing purposes. The overhanging surfaces provided by the narrowing of the voids 32 from the first surface to the second surface of the mask layer 30 assist in the reflection function by narrowing the escape path for the misdirected light.

By reducing the amount of light directed away from the viewer 14, the mask layer 30 can also protect light sensitive circuitry behind the screen 20 in a display device 10. This advantage can be more important in an FED panel where the field emitters are located in relatively close proximity to the screen 20.

The narrowing voids 32 of the mask layer 30 can also prevent the escape of secondary electrons from the luminescent material 26 which can be directed back towards other pixels, thereby causing undesired luminescence in those pixels.

Another advantage of the screen structure according to the present invention is that the matrix material preferably absorbs light, thereby increasing the quality of the image produced by the pixels in the screen according to the present invention.

Turning now to FIGS. 2–6, one method of manufacturing luminescent screens according to the present invention will be described. It will be understood that the method described is only one particular method, and that many different methods could be used to produce the screens.

Figure 2:
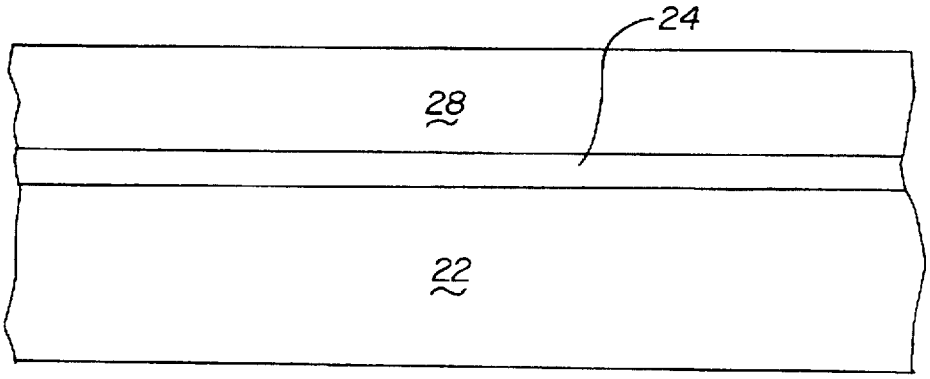
FIGS. 2–8 are schematic cross-sectional diagrams of the steps in one method of manufacturing a luminescent screen according to the present invention.

FIG. 2 depicts the substrate 22 coated with the transparent electrode 24. The methods of coating a substrate 22 with a transparent electrode 24 will not be described here and can be accomplished by any suitable method. Furthermore, as described above, the substrate 22 can be supplied of any suitable transparent material, such as glass, quartz, etc. Likewise, the electrode 24 can be supplied of any suitable transparent material, such as tin oxide, indium tin oxide, $SnO_2$, cadmium stannate, cadmium oxide, etc.

A layer of matrix material 28 is preferably deposited on the electrode 24 in any suitable manner that results in the matrix material 28 covering substantially all of the intended screen size with a uniformly thick layer. Some preferred matrix materials include, but are not limited to: carbon, graphite, black metal oxides (e.g., $PrMnO_3$, $SiO_2$:Ni cermet, CoO, etc.). Preferred functional characteristics of the matrix material 28 are that it is not electrically conductive (i.e., dielectric material); it is capable of being deposited on and adhering to the electrode 24; and it is preferably capable of being selectively removed to form the pattern of pixels for the screen 20.

One preferred matrix material 28 is $SiO_2$:Ni cermet which can be deposited on the electrode 24 by radio-frequency (RF) sputtering. The preferred thickness for the matrix material 28 is about 6 to about 7 μm. The matrix material 28 can be deposited in a single layer or, alternatively, it can be deposited in multiple layers to achieve the desired thickness.

After the matrix material 28 is deposited on electrode 24, the matrix material 28 is selectively removed to expose the underlying electrode 24 in the areas where the phosphor material 26 will be deposited. This step of selective removal typically involves masking the matrix material 28 in the desired pattern using, for example, a photoresist layer, and etching the matrix material 28 to selectively remove portions of it in the desired pattern. After the matrix material 28 is selectively removed, the photoresist can also be removed by any suitable method, thereby leaving the structure depicted in FIG. 3.

If the matrix material 28 is, for example, $SiO_2$:Ni cermet, it can be selectively removed by etching in hydrofluoric acid. Many other methods of selective removal of the matrix material 28 could be used in place of the preferred etching, including using other etchants, plasma etching, ion beams, laser ablation, etc. As an alternative to selective removal of the matrix material 28, it may also be possible to mask (with, e.g., photoresist) the electrode 24 in the desired pattern before depositing the matrix material 28, deposit the matrix material 28 only in the desired pattern, and remove the mask—leaving the structure shown in FIG. 3.

The next step is to deposit the desired phosphor material 26 in the distinct areas on the screen 20. The phosphor material 26 can be any organic or inorganic luminescent material (preferably inorganic for FED and CRT devices) and may include "activator" atoms that can modify the emitted radiation, such that the emission is in the visible region, as well as modify the emission intensity and the persistence of the image. Examples of suitable phosphor materials 26 include, but are not limited to: $Y_2O_3$:Eu for red, $Y_2SiO_5$:Ce for blue, and $Y_3(Al,Ga)_5O_{12}$:Tb for green, etc. Any suitable method of depositing the phosphor material 26 can be used, for example, some methods include electrophoresis, electrostatic coating, slurry, settling, etc. The phosphor material 26 is preferably deposited with a thickness of about 4 μm. The resulting structure after deposition of the phosphor material 26 is depicted in FIG. 4, in which distinct areas of phosphor material 26 are separated by the remaining matrix material 28 to form the pixels in the screen 20.

Figure 3:
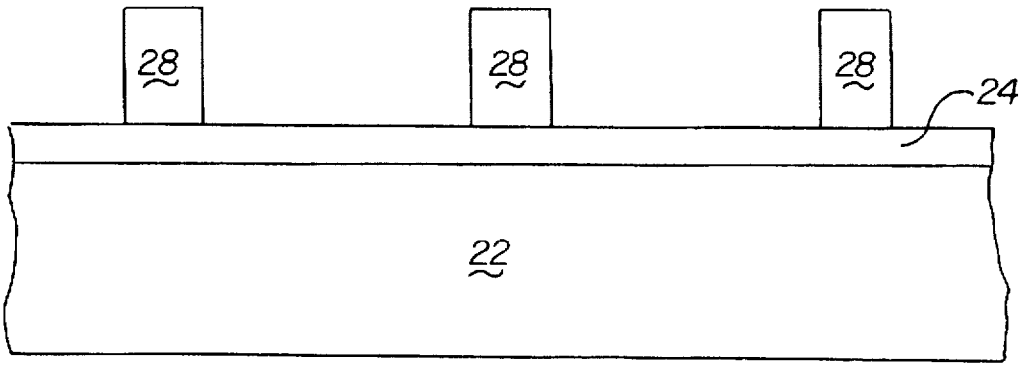
Figure 4:
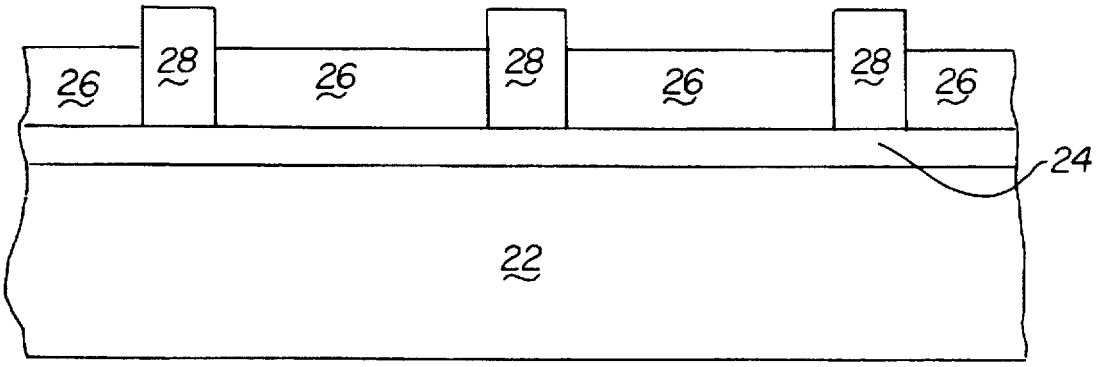

Although FIGS. 2–4 depict one method of providing the structure depicted in FIG. 4, it will be understood that, alternatively, the method could begin with depositing a layer of phosphor material 26, selectively removing it, and depositing the matrix material 28.

Figure 5:
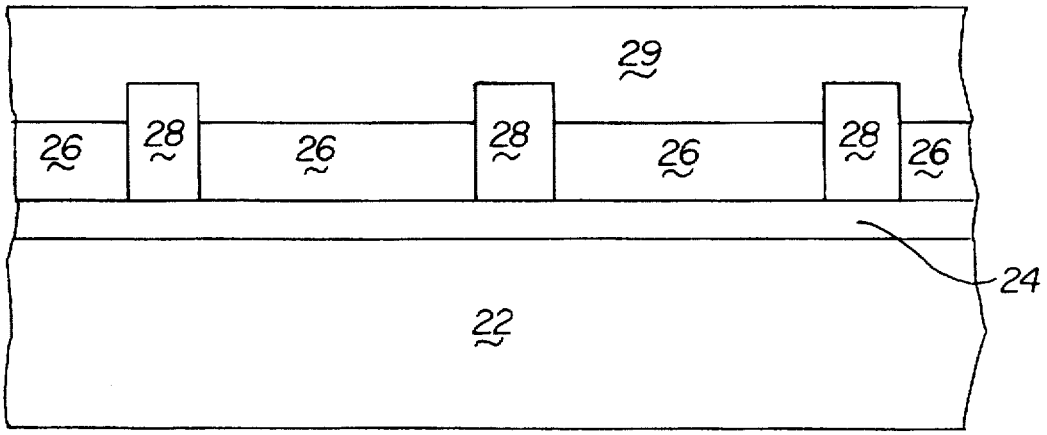
Figure 6:
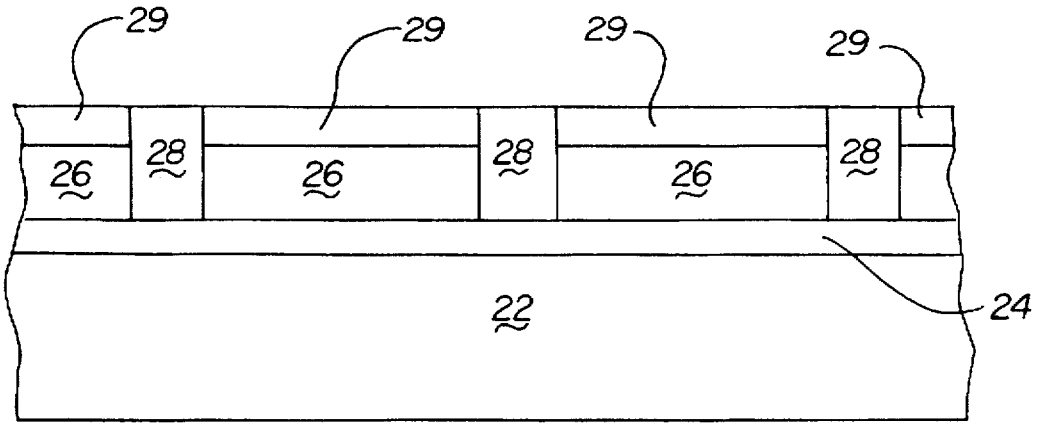

After the structure depicted in FIG. 4 is obtained, a layer of photoresist material 29 can be applied over the phosphor 26 and matrix 28 structures as shown in FIG. 5. The layer 29 is then partially removed until the upper surface of the matrix 28 is exposed while the resist layer 29 remains over the phosphor material 26 as shown in FIG. 6. Removal of the resist layer 29 is typically accomplished by polishing, although other methods could be substituted.

Figure 7:
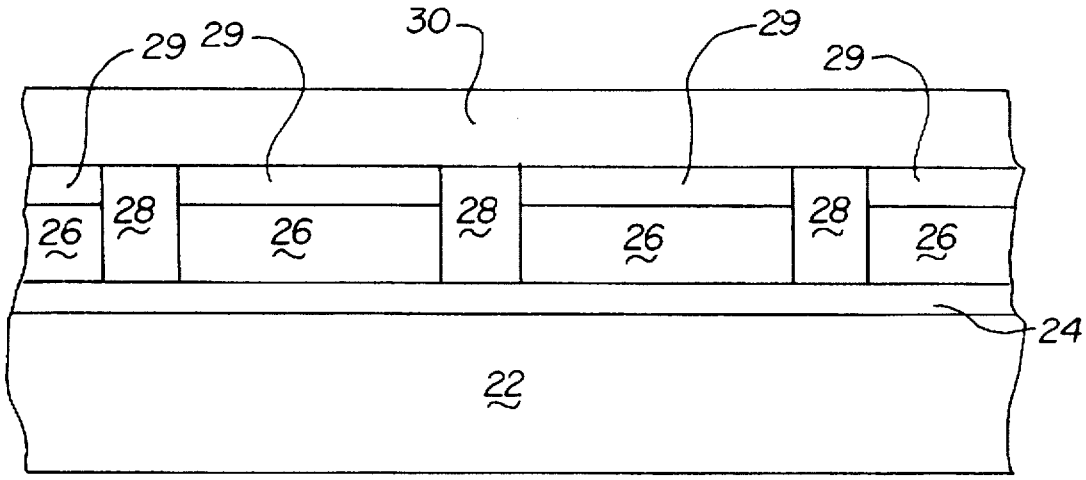

After the resist layer 29 has been removed to expose the upper surface of the matrix 28, a layer of mask material 30 is preferably deposited over substantially the entire screen 20, covering the resist layer 29 and matrix material 28 as shown in FIG. 7. Some preferred mask materials 30 include metals (e.g., aluminum, copper, chromium, molybdenum, etc.), and other materials such as silicon, silicon dioxide, etc. The preferred characteristics of the mask material 30 include good step coverage to adequately cover the junctions between the phosphor material 26 and matrix material 28 and the ability to be selectively removed in a desired pattern using an isotropic removal process. In addition, any materials used for the mask layer 30 should be electrically conductive or semiconducting to avoid the build-up of any charges that could interfere with proper operation of the display.

One preferred mask material 30 is aluminum and is preferably deposited to a thickness of about 2 μm using thermal evaporation. Those skilled in the art will understand, however, that aluminum for the mask material 30 could be deposited by any suitable method. Alternatives include chemical vapor deposition, sputter coating, atomic layer epitaxy, etc.

Figure 8:
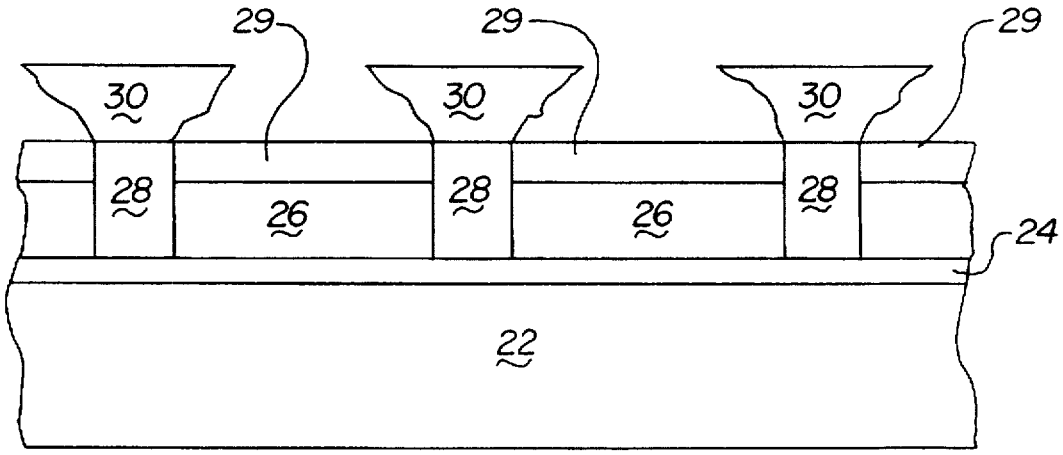

After the mask material 30 is deposited as depicted in FIG. 7, it is then selectively removed over the distinct areas of phosphor material 26 which are still protected by a layer of photoresist 29 in the preferred method as described above. This structure is depicted in FIG. 8. Although mask layer 30 is depicted as a single layer, it may be desirable in some instances to provide a mask layer 30 comprising two or more layers of the same or different materials.

If the mask material 30 is aluminum, one useful selective removal process is to pattern the mask layer 30 with a suitable photoresist layer, leaving the phosphor pixels bare and then etching the exposed mask layer 30 with sodium hydroxide or potassium hydroxide. That etching process is isotropic and results in undercutting of the masked areas of mask material 30, yielding voids 32 with the desired profile, i.e., wider near the phosphor material 26 and narrower near the electron source 12 (See FIG. 1). Other removal processes such as ion beam milling, laser ablation, etc. could be used to selectively remove the mask material 30 to form voids 32, provided that the process yields voids with the desired morphology. Alternatively, an anisotropic removal process could be used initially, followed by a more isotropic process, such as chemical etching to provide the desired mask layer morphology.

After selective removal of the mask layer 30 is complete, the photoresist layer 29 covering the phosphor material 26 can be removed by any suitable method. Preferably, the layer 29 is removed in a process that does not damage the underlying phosphor material 26. It will be understood that although photoresist has been described above as one desired material for layer 29, any suitable material that protects the phosphor material 26 during selective removal of the mask layer 30 and that can be removed without damaging the underlying phosphor material 26 could be substituted for photoresist.

Although not shown, it may be helpful to include one or more additional thin layers of material between the phosphor material 26 and/or matrix material 28. As used in connection with the present invention, such layers will be deemed integral with either the matrix material 28 or the mask material 30, such that the mask material 30 is still "attached" to the matrix material 28 for the purposes of the present invention. Such additional layers could enhance adhesion between the mask material 30 and the matrix material 28. They could also act as an etch stop to provide better control over the etching process used to selectively remove the mask material 30.

Any patents, patent documents, and publications cited herein are incorporated by reference in their entirety, as if each were individually incorporated by reference. Various modifications and alterations of this invention will become apparent to those skilled in the art without departing from the scope of this invention, and it should be understood that this invention is not to be unduly limited to the illustrative embodiments set forth herein.

What is claimed is:

1. A luminescent screen including a generally transparent substrate having a generally transparent electrode on the substrate, the screen comprising:

a) phosphor material on the electrode, the phosphor material being located in distinct areas on the electrode, wherein the distinct areas define pixels in the screen;

b) matrix material on the electrode, the matrix material being located between the pixels; and c) a mask layer having a first surface attached to the matrix material and a second surface opposite the first surface, the mask layer including voids formed through the first and second surfaces thereof, the voids generally corresponding to the pixels, wherein the area of each void is larger proximate the first surface than the area of the void proximate the second surface.

2. A screen according to claim 1, wherein the mask layer has a thickness of about 5 μm or less.

3. A screen according to claim 1, wherein the mask layer has a thickness of about 1 μm to about 2.5 μm.

4. A screen according to claim 1, wherein the mask layer comprises a metal.

5. A screen according to claim 1, wherein the ratio of the thickness of the matrix material to the thickness of the phosphor material in the pixels is about 1:1.5 or less.

6. A screen according to claim 1, wherein the ratio of the thickness of the matrix material to the thickness of the phosphor material in the pixels is about 1:1.5 to about 1:1.25.

7. A luminescent screen including a generally transparent substrate having a generally transparent electrode on the substrate, the screen comprising:

a) phosphor material on the electrode, the phosphor material being located in distinct areas on the electrode, wherein the distinct areas define pixels in the screen;

b) matrix material on the electrode, the matrix material being located between the pixels, wherein the ratio of the thickness of the matrix material to the thickness of the phosphor material in the pixels is about 1:1.5 or less; and c) a metal mask layer with a thickness of about 5 μm or less, the mask layer having a first surface attached to the matrix material and a second surface opposite the first surface, the mask layer including voids formed through the first and second surfaces thereof, the voids generally corresponding to the pixels, wherein the area of each void is larger proximate the first surface than the area of the void proximate the second surface.

8. A method of manufacturing a luminescent screen including a generally planar, generally transparent substrate having a generally transparent electrode on the substrate, the method comprising the steps of:

a) providing phosphor material on the electrode, the phosphor material being located in distinct areas on the electrode, wherein the distinct areas define pixels in the screen;

b) providing matrix material on the electrode, the matrix material being located between the pixels; and c) providing a mask layer having a first surface attached to the matrix material and a second surface opposite the first surface, the mask layer including voids formed through the first and second surfaces thereof, the voids generally corresponding to the pixels, wherein the area of each void is larger proximate the first surface than the area of the void proximate the second surface.

9. A method according to claim 8, wherein the ratio of the thickness of the matrix material to the thickness of the phosphor material in the pixels is about 1:1.5 or less.

10. A method according to claim 8, wherein the ratio of the thickness of the matrix material to the thickness of the phosphor material in the pixels is about 1:1.5 to about 1:1.25.

11. A method according to claim 8, wherein the steps of providing the phosphor material and the matrix material further comprise steps of:

a) providing a layer of the matrix material over substantially all of the electrode;

b) selectively removing portions of the matrix material to expose the electrode in the distinct areas defining the pixels; and c) providing phosphor material on the exposed portions of the electrode in the distinct areas defining the pixels.

12. A method according to claim 11, wherein the step of selectively removing the matrix material comprises etching the matrix material.

13. A method according to claim 8, wherein the step of providing the mask layer comprises the steps of:

a) providing a mask material over substantially the entire phosphor material and the matrix material; and b) selectively removing the mask material above the pixels to form the voids in the mask layer.

14. A method according to claim 13, wherein the step of selectively removing the mask material comprises etching the mask material.

15. A method according to claim 13, wherein the mask material comprises metal.

16. A method of manufacturing a luminescent screen including a generally planar, generally transparent substrate having a generally transparent electrode the substrate, the method comprising the steps of:

a) providing a layer of the matrix material over substantially all of the electrode;

b) etching the matrix material to selectively remove portions of the matrix material to expose the electrode in distinct areas on the screen;

c) providing phosphor material on the electrode, the phosphor material being located in distinct areas on the electrode, wherein the distinct areas define pixels on the screen;

c) providing a mask layer having a first surface attached to the matrix material and a second surface opposite the first surface, the mask layer including voids formed through the first and second surfaces thereof, the voids generally corresponding to the pixels, wherein the area of each void is larger proximate the first surface than the area of the void proximate the second surface, wherein the mask layer is provided by performing the steps of:

1) providing a mask material over substantially the entire phosphor material and the matrix material; and 2) selectively removing the mask material above the pixels by etching to form the voids in the mask layer.

17. A method according to claim 16, wherein the ratio of the thickness of the matrix material to the thickness of the phosphor material in the pixels is about 1:1.5 or less.

18. A method according to claim 16, wherein the ratio of the thickness of the matrix material to the thickness of the phosphor material in the pixels is about 1:1.5 to about 1:1.25.

19. A cathode ray tube display device comprising:

a) an electron gun; and b) a luminescent screen comprising:

1) a generally transparent substrate having a generally transparent electrode on the substrate;

2) phosphor material on the electrode, the phosphor material being located in distinct areas on the electrode, wherein the distinct areas define pixels in the screen;

3) matrix material on the electrode, the matrix material being located between the pixels; and 4) a mask layer having a first surface attached to the matrix material and a second surface opposite the first surface, the mask layer including voids formed through the first and second surfaces thereof, the voids generally corresponding to the pixels, wherein the area of each void is larger proximate the first surface than the area of the void proximate the second surface.

20. A device according to claim 19, wherein the ratio of the thickness of the matrix material to the thickness of the phosphor material in the pixels is about 1:1.5 or less.

21. A device according to claim 19, wherein the ratio of the thickness of the matrix material to the thickness of the phosphor material in the pixels is about 1:1.5 to about 1:1.25.

22. A field emission display device comprising:

a) a plurality of cold cathode emission structures; and b) a luminescent screen comprising:

1) a generally transparent substrate having a generally transparent electrode on the substrate;

2) phosphor material on the electrode, the phosphor material being located in distinct areas on the electrode, wherein the distinct areas define pixels in the screen;

3) matrix material on the electrode, the matrix material being located between the pixels; and 4) a mask layer having a first surface attached to the matrix material and a second surface opposite the first surface, the mask layer including voids formed through the first and second surfaces thereof, the voids generally corresponding to the pixels, wherein the area of each void is larger proximate the first surface than the area of the void proximate the second surface.

23. A device according to claim 22, wherein the ratio of the thickness of the matrix material to the thickness of the phosphor material in the pixels is about 1:1.5 or less.

24. A device according to claim 22, wherein the ratio of the thickness of the matrix material to the thickness of the phosphor material in the pixels is about 1:1.5 to about 1:1.25.

* * * * *

UNITED STATES PATENT AND TRADEMARK OFFICE

CERTIFICATE OF CORRECTION

PATENT NO. : 5,779,920
DATED : July 14, 1998
INVENTOR(S) : Chadha et al.

It is certified that error appears in the above-identified patent and that said Letters Patent is hereby corrected as shown below:

Column 1,
After the title of the application, insert:

-- GOVERNMENT RIGHTS

This invention was made with United States Government support under Contract No. DABT63-93-C-0025 awarded by the Advanced Research Projects Agency (ARPA). The United States Government has certain rights in this invention. --;

Column 8,
Line 4, please delete "matrix" and insert -- phosphor --;
Line 5, please delete "phosphor" and insert -- matrix --;
Line 7, please delete "matrix" and insert -- phosphor --;
Line 8, please delete "phosphor" and insert -- matrix --;
Line 18, please delete "matrix" and insert -- phosphor --;
Line 19, please delete "phosphor" and insert -- matrix --;
Line 47, please delete "matrix" and insert -- phosphor --;
Line 48, please delete "phosphor" and insert -- matrix --;
Line 50, please delete "matrix" and insert -- phosphor --;
Line 51, please delete "phosphor" and insert -- matrix --;

Column 9,
Line 38, please delete "matrix" and insert -- phosphor --;
Line 39, please delete "phosphor" and insert -- matrix --;
Line 41, please delete "matrix" and insert -- phosphor --;
Line 42, please delete "phosphor" and insert -- matrix --;

UNITED STATES PATENT AND TRADEMARK OFFICE

CERTIFICATE OF CORRECTION

PATENT NO. : 5,779,920
DATED : July 14, 1998
INVENTOR(S) : Chadha et al.

It is certified that error appears in the above-identified patent and that said Letters Patent is hereby corrected as shown below:

Column 10,
Line 16, please delete "matrix" and insert -- phosphor --;
Line 17, please delete "phosphor" and insert -- matrix --;
Line 19, please delete "matrix" and insert -- phosphor --;
Line 20, please delete "phosphor" and insert -- matrix --;
Line 42, please delete "matrix" and insert -- phosphor --;
Line 43, please delete "phosphor" and insert -- matrix --;
Line 45, please delete "matrix" and insert -- phosphor --;
Line 46, please delete "phosphor" and insert -- matrix --.

Signed and Sealed this

Twenty-sixth Day of March, 2002

*Attest:*

*Attesting Officer*

JAMES E. ROGAN
*Director of the United States Patent and Trademark Office*